US009301669B2

(12) United States Patent
Nygren

(10) Patent No.: US 9,301,669 B2
(45) Date of Patent: Apr. 5, 2016

(54) RAIL ASSEMBLY FOR A DISHWASHER BASKET

(71) Applicant: Electrolux Appliances Aktiebolag, Stockholm (SE)

(72) Inventor: Henrik Nygren, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 14/781,655

(22) PCT Filed: Apr. 22, 2013

(86) PCT No.: PCT/EP2013/058319
§ 371 (c)(1),
(2) Date: Oct. 1, 2015

(87) PCT Pub. No.: WO2014/173433
PCT Pub. Date: Oct. 30, 2014

(65) Prior Publication Data

US 2016/0058266 A1 Mar. 3, 2016

(51) Int. Cl.
*A47L 19/02* (2006.01)
*A47L 15/50* (2006.01)

(52) U.S. Cl.
CPC ..... *A47L 15/507* (2013.01)

(58) Field of Classification Search
CPC ..... A47L 15/507
USPC ..... 312/334.2, 334.7, 334.12, 228.1
See application file for complete search history.

(56) References Cited

U.S. PATENT DOCUMENTS 3,469,892 A * 9/1969 Langstroth ..... F16C 13/006 16/97
4,138,175 A * 2/1979 Tattershall ..... F25D 23/069 211/187
4,226,490 A * 10/1980 Jenkins ..... A47L 15/507 239/220
5,345,959 A * 9/1994 Matteson ..... A47L 15/507 134/201
5,409,309 A * 4/1995 Giddings ..... A47L 15/507 134/201
5,474,378 A * 12/1995 Smith ..... A47B 88/14 248/297.31
2003/0226580 A1* 12/2003 Welch ..... A47L 15/50 134/172
2006/0250058 A1* 11/2006 Stevens ..... A47L 15/502 312/311
2009/0085452 A1* 4/2009 Rehage ..... A47L 15/507 312/334.1
2010/0206342 A1* 8/2010 Gray ..... A47L 15/0049 134/115 R
2012/0074822 A1* 3/2012 Oppel ..... A47L 15/507 312/228
2012/0104914 A1* 5/2012 Jobst ..... A47L 15/507 312/228

FOREIGN PATENT DOCUMENTS

| | | | |
|---|---|---|---|
| DE | 10122834 | A1 | 11/2002 |
| DE | 10163870 | A1 | 7/2003 |
| EP | 1323371 | A2 | 7/2003 |
| EP | 1323372 | A2 | 7/2003 |
| EP | 1323548 | A2 | 7/2003 |
| GB | 2417191 | A | 2/2006 |

OTHER PUBLICATIONS

International Search Report and Written Opinion from International Application No. PCT/EP2013/058319 dated Dec. 10, 2013.

* cited by examiner

*Primary Examiner* — Hanh V Tran
(74) *Attorney, Agent, or Firm* — Alston & Bird LLP

(57) ABSTRACT

A rail assembly for a dishwasher basket that may include a rail to be connected to a side wall of the dishwasher basket; at least one support roller for guiding a front portion of the rail; a pair of guide rollers for guiding a rear portion of the rail, the pair of guide rollers may include a lower guide roller located to engage a lower guide face of the rail, and an upper guide roller located to engage an upper guide face of the rail; a lever element on which at least one of the guide rollers is mounted and which is rotatable about an axis extending generally in parallel to the axis of rotation of the at least one guide roller; and may include a spring element for rotationally biasing the lever element to urge the at least one guide roller against the rail.

10 Claims, 3 Drawing Sheets

RAIL ASSEMBLY FOR A DISHWASHER BASKET

CROSS-REFERENCE TO RELATED APPLICATIONS

This application is a national stage application filed under 35 U.S.C. 371 of International Application No. PCT/EP2013/058319 filed Apr. 22, 2013, which application is hereby incorporated by reference in its entirety.

FIELD OF THE INVENTION

The present invention relates to a rail assembly for a dishwasher basket.

BACKGROUND OF THE INVENTION

Dishwashers, in particular dishwashers for non-commercial use, commonly are designed as front loading devices having a washing compartment that is accessible via a front door which is pivotable about a horizontal axis. Such dishwashers commonly are equipped with at least two baskets. While the lowest basket usually is supported by rollers that are mounted along the lower lateral edges of the basket so that, in order to facilitate the loading of the lower basket, the basked can be pulled out of the washing compartment onto the opened door, the upper basked usually is mounted in a drawer-like fashion at guide rails which are provided along the side walls of the upper basket.

Such rail assemblies are shown for example in DE 101 63 870 A1. In this conventional dishwasher the upper basket is held at guide rails which are mounted for a sliding movement between two pairs of guide rollers that are mounted at a side wall of the washing tub of the dishwasher. In order to allow for a telescopic movement of the upper basket, the guide rails have a C-shaped cross-section which is open towards the dishwasher basket and which accommodates rollers that are rotatably mounted at a side wall of the dishwasher basket. In this manner, the rail can move on the one hand with respect to the basket and on the other hand with respect to the body of the dishwasher.

A problem often encountered with such rail assemblies for guiding a dishwasher basket is that in order to allow for a smooth movement of the dishwasher basket with respect to the dishwasher body, there has to be provided for a certain play between the guide rollers and the rail, which play, however, can lead to noise during operation of the dishwasher, as well as to an uneven sliding movement of the dishwasher basket when being pulled out of or pushed into the washing compartment, which even may result in a temporary blocking of the displacement of the basket.

In order to alleviate these problems several proposals have been made in the prior art to apply a biasing force between the rail and the guide rollers, so as minimize the effects of the inevitable play between these parts. Thus, in EP 1 323 371 A2 it was suggested to provide for a biasing element, such as a spring element, a spring-biased bar or a spring-biased roll, which bears against a guiding surface of the rail, so as to bias the rail towards the guide rollers. The solution suggested in EP 1 323 371 A2 is disadvantageous in that since the biasing means is provided in addition to the guiding rollers such biasing means provides for additional complexity and hence increases the costs of the system.

A similar solution was suggested in DE 101 22 834 A1, wherein in accordance with a first embodiment there is provided, in addition to two pairs of guiding rollers, a biasing roller which is pressed by means of a spring element towards the rail. In accordance with an alternative embodiment, instead of providing for a separate biasing roller, the lower and/or the upper guide roller shall be mounted directly on a spring element so as to urge the roller against the rail. While the first embodiment suggested in DE 101 22 834 A1 has the same disadvantages as the solutions provided in EP 1 323 371 A2, the alternative solution with guiding rollers that are directly mounted on spring elements is technically not feasible because when mounting the guide rollers on a free end of wire spring, as it is shown in this document, the guide rollers can be deflected in any special direction and hence it is not possible to provide for a well defined support for the guide rails.

SUMMARY OF VARIOUS EMBODIMENTS

It is an object of the present invention to provide for a rail assembly for a dishwasher basket which overcomes the disadvantages of the known solutions discussed above. In particular, it is an object of the present invention to provide for a rail assembly for a dishwasher basket which is simple to manufacture and yet provides for a stable and smooth guiding of the dishwasher basket.

In accordance with the present invention the above objects are solved in that in a rail assembly for a dishwasher basket comprising a rail to be connected to a side wall of the dishwasher basket, at least one support roller for guiding a front portion of the rail, and a pair of guide rollers for guiding a rear portion of the rail, wherein the said pair of guide rollers comprises a lower guide roller located to engage a lower guide face of the rail and an upper guide roller located to engage an upper guide face of the rail, in accordance with the present invention there is provided a lever element on which at least one of said guide rollers is mounted and which is rotatable about an axis extending generally in parallel to the axis of rotation of said at least one guide roller, and a spring element for rotationally biasing said lever element to urge said at least one guide roller against the rail.

In the present solution, for biasing the rail towards the guiding rollers, no additional biasing rollers are required, but rather the biasing is provided for by the guiding rollers themselves. On the other hand, by mounting the guiding roller that is to be urged against the guiding rail on the pivotable lever element, which itself preferably is a rigid member, in the solution suggested herein there is provided for a well defined movement of the said guiding roller in which also when such guiding roller is moved towards the guiding rail, the guiding roller always maintains its orientation and hence a tilting of the axis of rotation of the guiding roller is avoided.

In particular, in preferred embodiments, both the lower guide roller and the upper guide roller can be mounted on the lever element. Since the rail extends between the lower and the upper guide rollers, a rotation of the lever element caused by the biasing force of the spring element will result in both guide rollers being urged against the rail. Furthermore, by mounting both the lower guide roller and the upper guide roller on one and the same lever element, the manufacturing of the rail assembly can be effected with a minimum of parts and thus can be accomplished in a particular cost efficient way.

The number of parts of the rail assembly can be further minimized when the lever element is mounted so as to be rotatable about the axis of rotation of one of the guide rollers, in which case there can be provided for a common bearing element on which the lever element is pivotally mounted and on which the said guide roller is rotatably mounted. In such embodiments, preferably it is the lower guide roller that is rotatable mounted on the said common bearing element so that in the fully retracted position of the dishwasher basket, when the basket is located fully within the washing compartment such as during washing operation, the weight of the basket is supported by the lower guide rollers and hence does not act on the spring which urges the upper guide roller against the rail.

While for supporting the dishwasher basket it is generally sufficient to provide for a rail assembly in which the rear portion of the rail is held between a pair of guide rollers and wherein the front portion of the rail rests on a support roller which is located towards the front end of the washing tub, the rail can be further stabilized by providing in addition to a support roller that is located to engage a lower guide face of the rail, a restraint roller that is located to engage an upper face in the front portion of the rail. In this manner, the rail both in its rear portion and its front portion is held between two guide rollers and thus cannot be displaced, for example, when during a washing cycle the weight distribution within the dishwasher basket should change due to a movement of articles, or if for example some hollow vessel inadvertently is turned upside down and fills with cleaning liquid.

While the support roller and the restraint roller can be mounted independently from each other at the side wall of the washing tub, the support roller and the restraint roller also can be mounted, similarly as the lower and upper guide rollers, on a lever element which is rotationally biased and thus urges the support roller and/or the restraint roller against the rail.

Manufacturing of the rail assembly can be further simplified when for the provision of the support roller and the restraint roller an assembly of lever mounted rollers is employed which is identical to that which is used for the lower and the upper guide roller.

In order to facilitate operation of a dishwasher that is equipped with a rail assembly as suggested herein, the connection between the rail and the side wall of the dishwasher basket preferably is adapted for telescopic movement of the dishwasher basket with respect to the rail, so that the basket can be pulled out further from within the washing compartment, and preferably can be fully pulled out from the washing compartment.

Such telescopic movement of the dishwasher basket with respect to the rail can be accomplished by providing for a rail having a generally C-shaped cross section which is open towards the dishwasher basket and which accommodates rollers that are rotatably mounted at the dishwasher basket. In such a rail assembly the rail thus on the one hand can move with respect to guide rollers and on the other hand can move with respect to the basket, which thus markedly increases the amount by which the basket can be pulled out from the washing compartment.

In a further aspect of the present application there is provided a dishwasher with a washing chamber and at least one dishwasher basket which is connected to a side wall of the washing chamber by rail assemblies.

BRIEF DESCRIPTION OF THE SEVERAL VIEWS OF THE DRAWINGS

Preferred embodiments of the present invention are described in further detail below by reference to the drawings in which.

DETAILED DESCRIPTION

Figure 1:
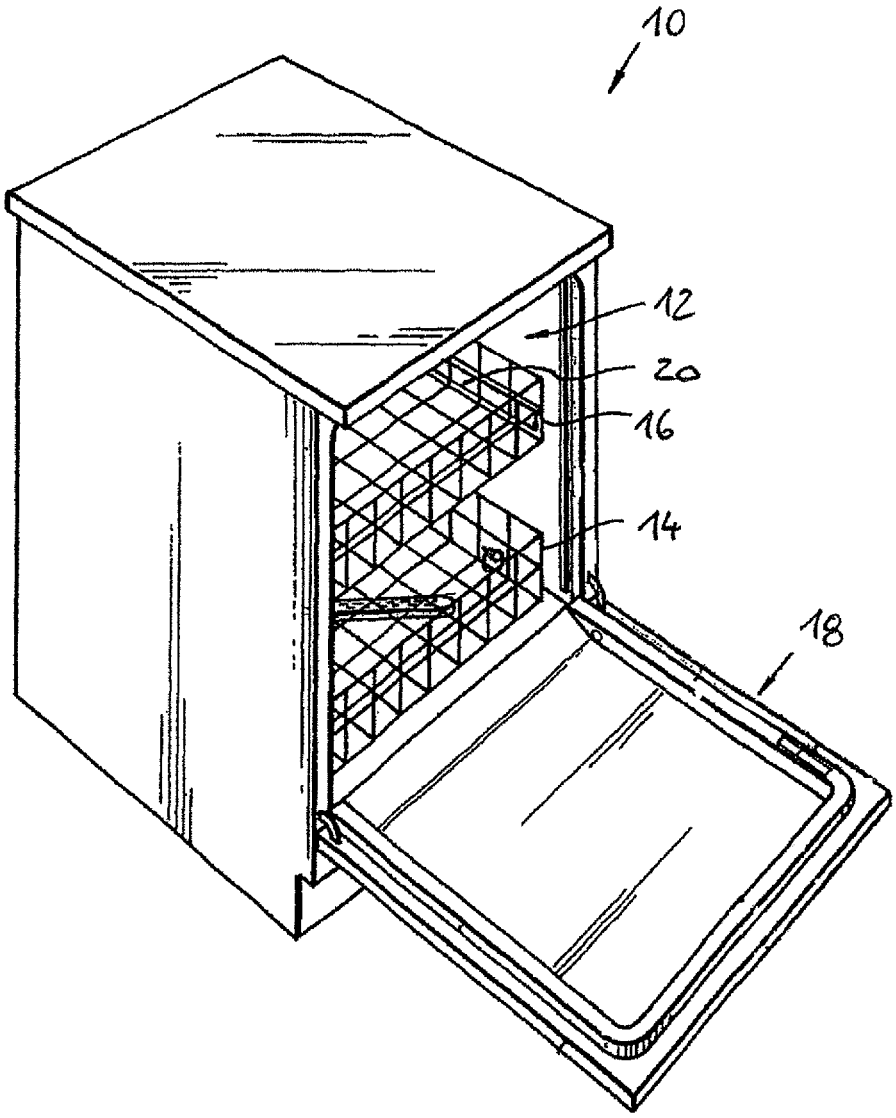
FIG. 1 is a schematic perspective view of a dishwasher in which a rail assembly as suggested herein is employed.

In FIG. 1 there is shown a dishwasher 10 having a washing compartment 12 in which articles to be cleaned can be arranged within a lower basket 14 and an upper basket 16. While for loading and unloading the dishwasher, the lower basket 14 can be pulled out onto the opened front door 18, to which end the lower basket 14 can be provided along its lower lateral edges with rollers that are guided on guiding tracks on the door 18, the upper basket 16 is held at rails 20 that are provided between the side walls of the upper basket 16 and the side walls of the washing compartment 12, as will be explained in further detail by reference to FIG. 2.

Figure 2:
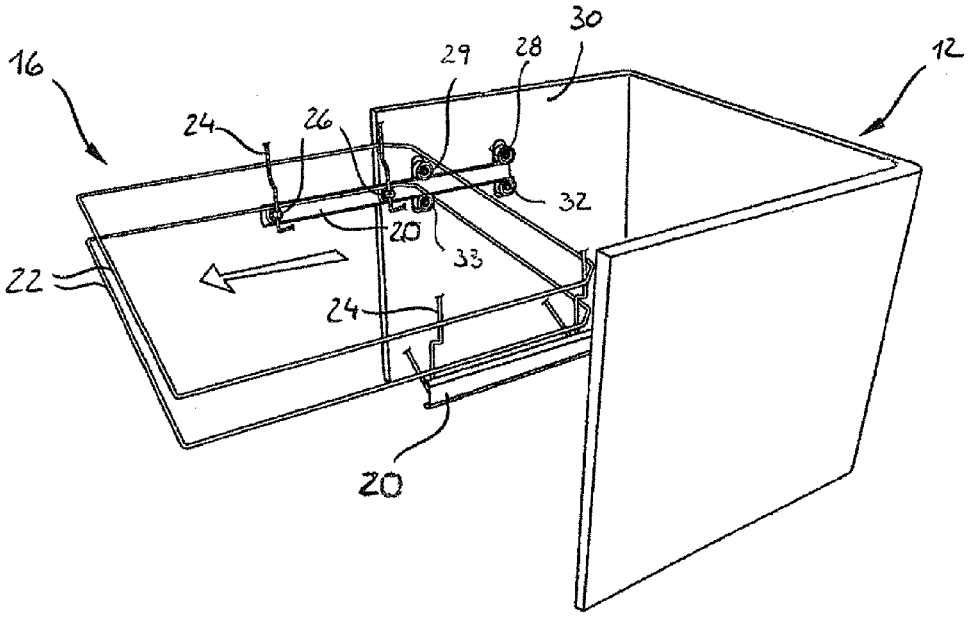
FIG. 2 is a schematic perspective view of the washing tub of the dishwasher of FIG. 1 and the upper basket.

FIG. 2 is a simplified view of the dishwasher of FIG. 1 in which only those parts are illustrated to which reference is made in the description of the rail assembly, but wherein for ease of illustration all further components of the dishwasher are not shown. Thus, in FIG. 2 the upper basket 16 is illustrated only by reference to two of its horizontal bars 22 as well as those of the vertical struts 24 where rollers 26 are supported which are accommodated within the rails 20.

As illustrated in FIG. 2, rails 20 have a generally C-shaped cross-section which is open towards the dishwasher basket 16 so as to accommodate the rollers 26, wherein the upper and the lower surfaces of the C-shape of rail 20 provide an upper and a lower guide face at which the rails 20 are guided at rollers 28, 29, 32 and 33 provided at the side walls 30 of the washing tub.

Figure 3:
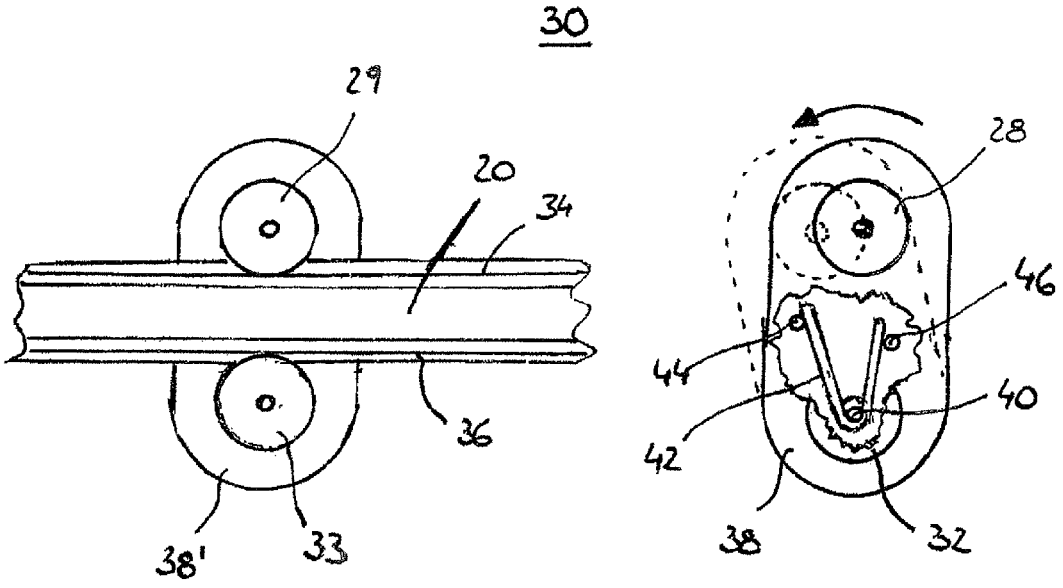
FIG. 3 shows a portion of the rail assembly in further detail.

In FIG. 3 there is shown a schematic view of the rail assembly and in particular of the guide rollers that are mounted to the side wall 30 of the washing tub. The rail 20 is guided between two pairs of guide rollers 28, 32 and 29, 33. Thus, while for supporting basket 16 it would be sufficient to provide for a rail assembly in which the rear portion of the rail is held between a pair of guide rollers 28, 32 and wherein the front portion of the rail rests on a support roller 33, in the embodiment shown in FIG. 3 there are provided two generally identical pairs of guide rollers, wherein the front pair is formed by a support roller 33 and a restraint roller 29. In the rail assembly shown in FIG. 3, an upper guide face 34 of rail 20 is engaged by the upper guide rollers 28, 29, and a lower guide face 36 of rail 20 is engaged by the lower guide rollers 32, 33. In order to provide for a biasing of the guide rollers with respect to the rail, the upper guide rollers 28, 29 and the lower guide rollers 32, 33 are rotatable mounted on lever elements 38, 38'.

As will be explained by reference to the rear pair of guide rollers 28, 32, the lever elements 38, 38' are mounted to the side wall 30 of the washing tub so as to be pivotable about an axis 40 which also serves for rotatably supporting the lower guide roller. As illustrated in the partially broken away illustration of FIG. 3, at the rear side of lever element 38, 38' there is provided a spring element 42, a first leg of which rests against a stop 44 which is fixedly connected to the side wall 30 of the washing tub, wherein a second leg of spring element 42 rests against a stop 46 which is fixedly connected to lever element 38 and which can be formed integrally therewith. Spring element 42 urges the lever element 38 so as to perform a rotation in FIG. 3 in the counterclockwise direction, as is illustrated by the arrow shown in FIG. 3, which rotation in turn provides for a biasing action of both the upper guide roller 28 and the lower guide roller 32 against rail 20.

As can be readily understood from the illustration of FIG. 3, the guide rail assemblies suggested herein provide for a stable support of the dishwasher basket 16, which in a position fully within the washing compartment rests with its entire weight and that of any articles to be cleaned and accommodated therein on the bearing element 40, but which nevertheless provides for a play free guiding of the guide rails 20.

The invention claimed is:

1. Rail assembly for a dishwasher basket, comprising:

a rail to be connected to a side wall of the dishwasher basket;

at least one support roller for guiding a front portion of the rail; and a pair of guide rollers for guiding a rear portion of the rail, said pair of guide rollers comprising a lower guide roller located to engage a lower guide face of the rail, and an upper guide roller located to engage an upper guide face of the rail;

a lever element on which at least one of said guide rollers is mounted and which is rotatable about an axis extending generally in parallel to the axis of rotation of said at least one guide roller; and a spring element for rotationally biasing said lever element to urge said at least one guide roller against the rail.

2. The rail assembly of claim 1, wherein both the lower guide roller and the upper guide roller are mounted on said lever element.

3. The rail assembly of claim 1, wherein said lever element is mounted to be rotatable about the axis of rotation of one of said guide rollers.

4. The rail assembly of claim 3, comprising a common bearing element for pivotally mounting the lever element and for rotatably mounting said one of said guide rollers.

5. The rail assembly of claim 4, wherein the guide roller that is rotatably mounted on the common bearing element is the lower guide roller.

6. The rail assembly of claim 1, wherein said support roller is located to engage a lower guide face in the front portion of the rail, the rail assembly further comprising a restraint roller located to engage an upper guide face in the front portion of the rail.

7. The rail assembly of claim 6, wherein at least one of said support roller and said restraint roller is mounted on a second lever element which is rotationally biased to urge said support roller and/or said restraint roller against the rail.

8. The rail assembly of claim 1, wherein the connection between the rail and the side wall of the dishwasher basket is adapted for telescoping movement of the dishwasher basket with respect to the rail.

9. The rail assembly of claim 8, wherein said rail has a generally C-shaped cross-section which is open towards the dishwasher basket and which accommodates rollers rotatably mounted to the dishwasher basket.

10. Dishwasher with a washing chamber and at least one dishwasher basket which is connected to a side wall of the washing chamber by rail assemblies as defined in claim 1.

* * * * *